United States Patent [19]

Carpenter et al.

[11] Patent Number: 4,997,018

[45] Date of Patent: Mar. 5, 1991

[54] MOUNTED KNIFE SYSTEM

[75] Inventors: Charles T. Carpenter; Robert M. Bayly, both of Lake Oswego, Oreg.

[73] Assignee: Commercial Knife, Inc., Wilsonville, Oreg.

[21] Appl. No.: 542,882

[22] Filed: Jun. 25, 1990

[51] Int. Cl.[5] ..... B27C 7/10; B27G 13/00

[52] U.S. Cl. ..... 144/241; 144/176; 241/92; 241/298; 407/48

[58] Field of Search ..... 144/162 R, 176, 218, 144/241; 407/33, 43, 48, 51, 61, 99, 102; 241/92, 298

[56] References Cited

U.S. PATENT DOCUMENTS

| | | | |
|---|---|---|---|
| 4,047,670 | 9/1977 | Svensson | 144/176 |
| 4,298,044 | 11/1981 | Hansel et al. | 144/241 |
| 4,423,758 | 1/1984 | Haller et al. | 144/241 |
| 4,503,893 | 3/1985 | Demopoulos | 144/241 |
| 4,545,413 | 10/1985 | Sunberg et al. | 144/241 |
| 4,557,305 | 12/1985 | Berger et al. | 144/241 |
| 4,669,516 | 6/1987 | Carpenter et al. | 144/241 |
| 4,771,718 | 9/1988 | Carpenter et al. . | |
| 4,784,337 | 11/1988 | Nettles et al. | 144/241 |
| 4,850,408 | 7/1989 | Carpenter et al. | 144/176 |

*Primary Examiner*—W. Donald Bray

*Attorney, Agent, or Firm*—Kolisch, Hartwell, Dickinson, McCormack & Heuser

[57] ABSTRACT

A double-edged knife detachably mounted on a counter knife. The knife overlies surfaces inclined and oriented so that when the knife is clamped in place, it is held well rearwardly an edge in the knife which is exposed for cutting. Fasteners hold the counter knife and these are protected from damage by a shoulder.

8 Claims, 2 Drawing Sheets

MOUNTED KNIFE SYSTEM

This invention relates to cutting apparatus of the type that includes a knife held on a support, and where the knife and support are moved relative to material to be cut to produce cuttings. Exemplary of such apparatus are so-called chipper granulators, employed in the plastic industry to produce plastic granules, and so-called wood chippers, employed in the wood products industry to produce wood chips from wood material fed the apparatus.

In recent years, so-called double-edged knives have found increasing popularity, since through turning of the knife, a convenient way is provided for replacing a worn cutting edge on one side of the knife with a sharp cutting edge extending along the opposite side of the knife. Double-edged knives lend themselves for use in a returnable system, wherein after dulling of both knife edges, a knife is either returned or scrapped, with the elimination of any grinding requirement by the user.

This invention concerns cutting apparatus which includes a double-edged knife detachably mounted in the apparatus, and improvements in the mounting for the knife contributing to ease of replacement or turning of the knife when such is necessary.

Another object is to provide improvements in the mounting of a knife, whereby such, even though of relatively small crosssectional size, tends to be held more firmly, with the knife, therefore, producing a more uniformly cut product.

These and various other objects and advantages are attained by the invention, which is described hereinbelow in conjunction with the accompanying drawings, wherein.

The particular apparatus with which the present invention is disclosed is chipper apparatus featuring a rotatable disc which into a log or other material to reduce it to chips. By so describing the invention, however, it is not intended to so limit the invention, as it is appreciated features may well be applicable to other types of cutting apparatus.

Figure 1:
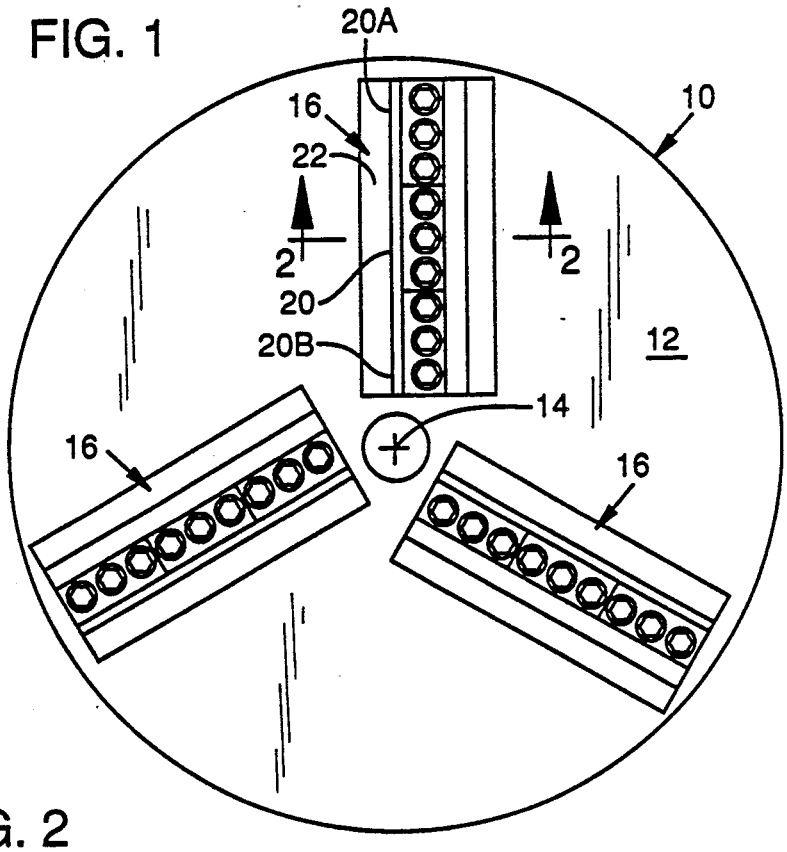
FIG. 1 is a view looking at the front of a chipper disc, such being exemplary of various forms of cutting apparatus that may employ the double-edged knife and its mounting of the instant invention.

Referring to the drawings, illustrated in FIG. 1 at 10 is a chipper disc which is substantially circular in outline, has a substantially flat disc surface 12 forming the face of the disc, and which is mounted in the chipper apparatus for powered rotation about its axis 14. Arranged with such extending generally radially on the chipper disc are multiple knife assemblies, designated generally at 16. Although three such assemblies are shown, it should be obvious that the number and relative spacing of these assemblies are subject to variation, with different sizes and types of chipper apparatus.

Each of the knife assemblies is illustrated as having three knives disposed end to end and indicated at 20, 20A, and 20B. These are aligned with each other in the assembly. Again, it should be understood that the number of knives will vary according to the individual installation.

During use, the chipper disc is rotated in a counterclockwise direction in FIG. 1. Immediately in advance of the knives in the knife assembly is an opening 22. During operation of the chipper and with the advancing of a log or other wood against the disc, the knives in a knife assembly shave wood chips from the wood with such then travelling through an opening 22 to be expelled from the chipper.

Figure 3:
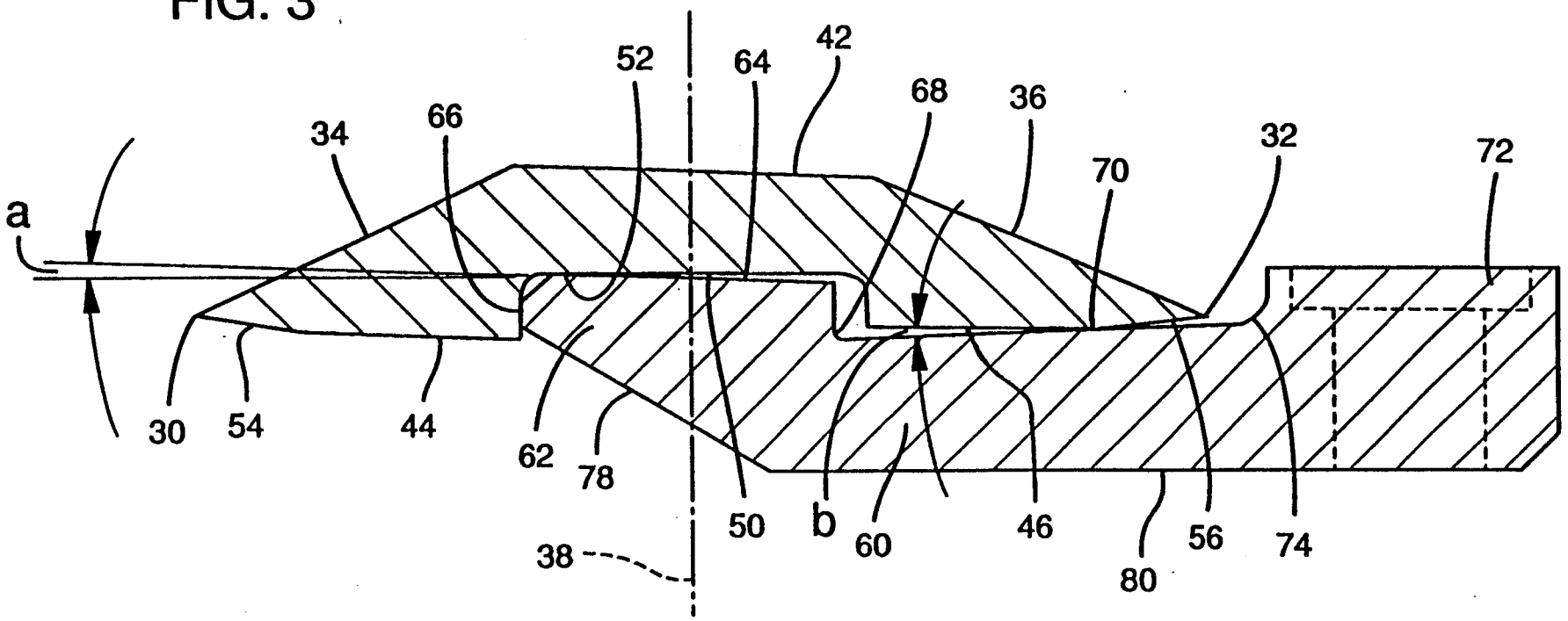
FIG. 3 is a cross-sectional view, on an even larger scale, illustrating the knife and a counter knife present in the knife mounting.

Considering the construction of a knife, and referring to FIG. 3, the knife is bounded along opposite margins by elongate cutting edges indicated at 30 and 32. These parallel each other. That part of the knife which appears at the top of FIG. 3 is referred to as the back side of the knife, and the opposite side or the side adjacent the bottom is the front side.

The back side of the knife is defined by a pair of back knife surfaces 34, 36 extending inwardly on the knife from respective cutting edges. These may have substantially equal width and ordinarily are planar, and are inclined at a common acute angle with respect to a plane 38 which bisects the knife. Extending between and joining with these back knife surfaces, is what is referred to as a bearing surface 42. With the knife being symmetrical, plane 38 described bisects the bearing surface.

The front side of the knife is defined by a pair of socalled front knife surfaces 44, 46. Midway between the knife's edges and between these front knife surfaces and extending the length of the knife is a key-receiving channel 50. Knife surfaces 46, 48 and have equal width and the key-receiving channel is bisected by plane 38.

The knife may be relief ground at each of its opposite edges. Thus there are illustrated flat relief surfaces 54, 56. Each joins with a back knife surface in delineating an edge and extends to meet with a front knife surface and has minor extent compared to a front knife surface. The relief surface may incline with respect to the plane of the knife edges at a slight acute angle, typically ranging from four to seven degrees.

A knife support or counter knife is illustrated at 60. This counter knife has an elongate key portion 62 extending along the length thereof along one margin. The key is bounded by a key surface 64 and opposite edge surfaces 66, 68. Edge surface 68 joins with a knife support surface 70. A ledge 72 extends along the margin of the counter knife opposite that margin having key portion 62. Knife support surface 70 joins with ledge 72 through a shoulder 74.

The counter knife on its underside is bounded by a wear surface 78 which extends at an acute angle with respect to key surface 64. Wear surface 78 joins with a base surface 80.

A knife is supported on the disc with its front facing the counter knife, and key portion 62 lying within channel 50. The knife is held with one of its edges exposed and one of its front knife surfaces, such as surface 44, unsupported. The opposite front knife surface, i.e., surface 46 lies opposite knife support surface 70. 10 Referring to FIG. 2, the counter knife is mounted on a holder 82. Clamping the knife against the counter knife is clamp 84 also secured to and mounted on the holder.

Considering the mounting of the counter knife, distributed at intervals along the length of ledge 72 are series of bores such as bore 90. Aligned with these bores are threaded bores 92 in the holder. Screw fasteners, such as fastener 94, pass through a bore 90 and are screwed into a threaded bore 92 and serve to detachably secure the counter knife in place.

Considering the clamp, such is provided with bores 98 distributed along its length. These register with threaded bores 100 in the holder. Screw fasteners such as screw fastener 102 pass through a bore 98 and turn into a threaded bore 100 secure the clamp in place.

Figure 2:
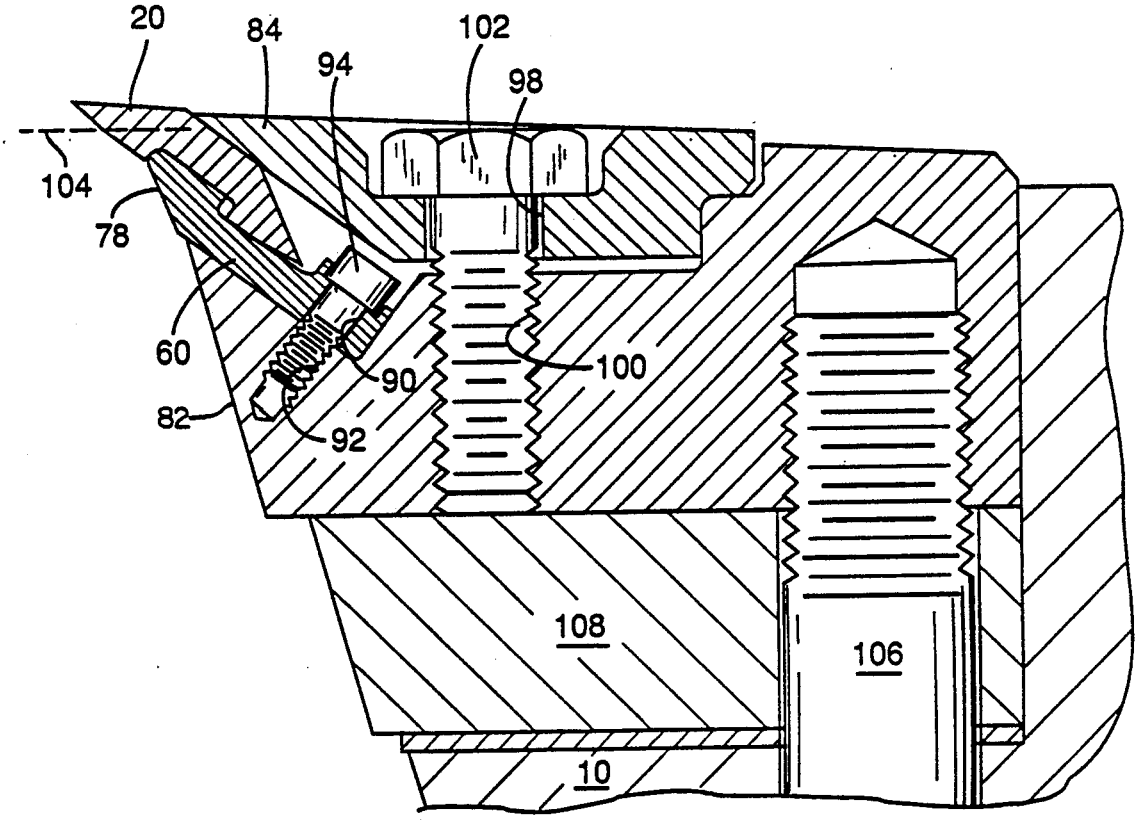
FIG. 2 is a view, on a somewhat larger scale, illustrating, in cross-section, the knife and its mounting, and taken generally along the line 2—2 in FIG. 1.

In FIG. 2, the plane of the disc surface which mounts the knife is shown at 104. It will be seen that the knife is held with one of its edges exposed and projected beyond this plane and with a front knife surface operable to deflect wood chips cut away from the wood material and downwardly and to the right in FIG. 2. The chip material then travels over wear surface 78 of the counter knife. With the counter knife detachably mounted, it may be replaced if excessive wear occurs in the wear surface 78. Furthermore, a counter knife may be selected which has slope to its wear surface precisely designed to produce the type of chips desired.

It will be noted that clamp 84 clamps downwardly on the back bearing surface 42 of the knife to urge the knife against key surface 64 and knife support surface 70. To insure that the knife is supported well rearwardly of the cutting edge that is doing the cutting, key surface 64 inclines at a slight angle (shown at a) with respect to surface 52 of the channel 50, typically between 0.8 and 2.0 degrees. The incline is such that progressing rearwardly in the key, surface 64 diverges from surface 52. Knife support surface 70, on the other hand, progressing toward ledge 72, inclines in the opposite direction at a slight angle (shown at b) with respect to the overlying knife surface. Again, this inclination may be between 0.8 and 2.0 degrees. By so inclining the surfaces, assurance is had that the knife is supported well rearwardly of the key-receiving channel in the knife.

It will further be noted that the fasteners which secure the counter knife in place are disposed rearwardly of the knife, and shoulder 74 of ledge 72 provides a barrier located between the heads of the fasteners and the rear margin of knife support surface 70.

This is important in that in the event the knife should become torn loose from its mounting, and as a result be thrown backwardly on the counter knife, the rear knife edge is prevented by this shoulder from damaging the fasteners holding the counter knife in place.

The holder together with the clamp, counter knife, and knife are mounted on the chipper disc utilizing fasteners such as fastener 106. A control plate or filler piece 108 interposed between the holder and the disc provides a means, through proper selection of the plate thickness, of controlling the position that the holder has with respect to the disc and the amount that the knife protrudes into the material being cut.

While a particular embodiment of the invention has been described, obviously modifications and variations are possible.

It is claimed and desired to secure by Letters Patent:

1. Cutting apparatus including a knife detachably mounted on a support, the knife being bounded on opposite sides by elongate cutting edges defining a plane and having a back side defined by a pair of back knife surfaces extending inwardly from respective cutting edges and a bearing surface joining the back knife surfaces, the knife having a front side including an elongate key-receiving channel midway between the cutting edges and a pair of front knife surfaces extending outwardly from the channel toward respective cutting edges, said support including an elongate raised key portion that fits within the key-receiving channel, one cutting edge of the knife being located on one side of the key portion and free of the support, said support further including a support surface extending from the opposite side of the key portion that inclines toward the knife progressing from the key portion and that defines an acute angle with respect to the plane of said cutting edges.

2. The apparatus of claim 1, which further includes a holder, fastener means detachably mounting the support on said holder, and a shoulder located beyond said support surface from said opposite side of the key portion serving to inhibit movement of the knife onto the fasteners.

3. The apparatus of claim 1, which further includes a clamp having a clamping surface, and said clamp bears against the bearing surface of the knife.

4. The apparatus of claim 1, which further includes a clamp having a clamping surface and said clamp bears against the bearing surface of the knife, a holder, fastener means detachably mounting the support surface on said holder, and a shoulder located beyond said support surface from said opposite side of the key portion serving to inhibit movement of the knife into the fasteners.

5. The apparatus of claim 1, wherein said acute angle is within the range of 0.8 to 2.0 degrees.

6. In cutting apparatus, a knife bounded on opposite sides by elongate cutting edges, the knife having a front side including an elongate key-receiving channel midway between the cutting edges and a pair of front knife surfaces extending outwardly from the channel toward respective cutting edges, a support for the knife, said support including an elongate raised key portion that fits within the key-receiving channel, one cutting edge being located on one side of the key portion and free of the support, said support further including a support surface extending from the opposite side of the key portion that underlies and engages the knife, a holder, and fastener means detachably mounting the holder on said support, said fastener means being located beyond said knife from said key portion, the support further including a shoulder generally extending the length of the knife interposed between said fastener means and the knife and serving to inhibit movement of the knife onto the fastener means.

7. In chipper apparatus having a rotatably mounted chipper disc with the disc including a disc surface which is normal to the rotation axis of the disc, a chipper knife bounded on opposite sides by elongate cutting edges defining a plane and having a back side defined by a pair of back knife surfaces extending inwardly from respective cutting edges and a bearing surface joining the back knife surfaces, the knife having a front side including an elongate key-receiving channel midway between the cutting edges and a pair of front knife surfaces extending outwardly from the channel toward respective cutting edges, a support for the knife mounted on said disc, said support including an elongate raised key portion that fits within the key-receiving channel, one cutting edge of the knife being located free of the support on one side of the key portion, said support further including a support surface extending from the opposite side of the key portion that inclines toward the knife progressing from the key portion and that defines an acute angle with respect to the plane of the cutting edges.

8. The chipper apparatus of claim 7, which further includes a holder mounted on said disc, said support for the knife being detachable from the holder, fasteners securing said support to said holder, said fasteners being aligned in a row disposed beyond said knife from said key portion, said support further including a shoulder interposed between the row of fasteners and the knife serving to act as a protective barrier and inhibiting movement of the knife onto the fasteners.

* * * * *